United States Patent [19]

Koerner et al.

[11] Patent Number: 4,654,492

[45] Date of Patent: Mar. 31, 1987

[54] SWITCH DRIVE

[75] Inventors: Gerhard Koerner, Schriesheim; Walter Hahn, Frankfurt; Horst Plettner, Hanau, all of Fed. Rep. of Germany

[73] Assignee: BBC Aktiengesellschaft Brown, Boverie & Cie, Baden, Switzerland

[21] Appl. No.: 722,796

[22] Filed: Apr. 12, 1985

[30] Foreign Application Priority Data

Apr. 12, 1984 [DE] Fed. Rep. of Germany ..... 3413793

[51] Int. Cl.[4] ..... H01H 3/26

[52] U.S. Cl. ..... 200/153 P

[58] Field of Search ..... 200/153 P; 318/150, 318/161; 290/4 R; 322/4; 310/74, 68 A

[56] References Cited

U.S. PATENT DOCUMENTS 2,567,636 9/1951 Cuny ..... 318/150

3,679,960 7/1972 Hirokawa et al. ..... 310/74

4,137,436 1/1979 Barkan et al. ..... 200/153 SC

*Primary Examiner*—Stephen Marcus

*Assistant Examiner*—Renee S. Luebke

*Attorney, Agent, or Firm*—Herbert L. Lerner; Laurence A. Greenberg

[57] ABSTRACT

A switch drive assembly includes a switch having a contact and a control shaft for actuating the contact and switching substantially currentlessly, and a drive having a drive motor, a flywheel accumulator connected to the drive motor for receiving a change from the drive motor immediately prior to a switching process, the flywheel accumulator being coupled to the control shaft for discharging during a switching process and executing a previously initiated switching process, the drive motor acting as a generator for generation of a self-sufficient voltage supply during discharge of the flywheel accumulator.

7 Claims, 4 Drawing Figures

SWITCH DRIVE

The invention relates to a switch drive with a contact being actuatable by a control shaft for switching substantially without current, preferably in encapsulated, compressed-gas-insulated switching installations.

Disconnect switches, which are called "disconnects" for short, are switches for opening and closing a current path substantially without current, by establishing a reliably recognizable opening gap when opening a disconnect switch such as is required in medium and high-voltage switching installations. Disconnect switches are only operated intentionally, i.e. not automatically.

Due to the introduction of electrical operating means having increasing power ratings, as well as the introduction of novel methods of network operations, new requirements as to quality are demanded of the operating means with regard to power transmission and distribution.

A motor drive for disconnect switches is known which acts directly on a control shaft. The disconnect switch is furthermore equipped with an additional manual drive for emergency operation. It has been found to be a disadvantage that emergency operation occurs if the network voltage fails during an initiated switching operation and the switch no longer reaches its end position.

It is accordingly an object of the invention to provide a switch drive which overcomes the hereinafore-mentioned disadvantages of the heretofore-known devices of this general type, and through which a once initiated switching operation is reliably carried out.

With the foregoing and other objects in view there is provided, in accordance with the invention, a switch drive assembly, especially in encapsulated, compressed-gas-insulated switching installations, comprising a switch having a contact and a control shaft for actuating the contact and switching substantially currentlessly, and a drive having a drive motor, a flywheel accumulator connected to the drive motor for receiving a charge from the drive motor immediately prior to each switching process, the flywheel accumulator being coupleable to the control shaft for discharging during a switching process and executing a previously initiated switching process, the drive motor acting or being connected as a generator for generation of a self-sufficient voltage supply during discharge of the flywheel accumulator.

The advantages achieved with the invention are in particular that the drive which is constructed as an accumulator drive, completes a once initiated switching operation, so that the switch reaches its defined end position "on" or "off" in a reliable manner. An undefined intermediate position of the switch, in which the contacts may under some conditions be damaged by a standing arc, is thereby pre- cluded.

It is furthermore advantageous if not only the switch is supplied with drive power from the power accumulator but that it is furthermore utilized for generating a separate voltage supply for the control of the switch, by switching the drive motor connected to the power accumulator from motor to generator operation.

Overall, the switch has higher operating reliability.

In accordance with another feature of the invention, the drive motor is a permanent magnet motor.

In accordance with a further feature of the invention, the drive motor is a universal motor or single-phase series motor.

In accordance with an added feature of the invention, there is provided a centrifugal switch for triggering discharge of the flywheel accumulator.

In accordance with an additional feature of the invention, the disconnect switch includes a gear disposed on the control shaft, and the drive includes another shaft rigidly interconnecting the drive motor and the flywheel accumulator, and a pinion loosely disposed on the other shaft and meshing with the gear, the pinion being fixed in place during charging of the flywheel accumulator and being coupled to the other shaft during discharging of the flywheel accu- mulator.

In accordance with a concomitant feature of the invention, there is provided an electromagnetic brake for fixing the pinion in place, and an electromagnetic clutch for coupling the pinion to the other shaft, the locking brake and the clutch being supplied with voltage by the drive motor acting or connected as a generator.

The accumulator drive is a separate component that can be used in a disconnect switch instead of a conventional drive. Furthermore, the accumulator drive is also suitable for operating grounding switches.

Other features which are considered as characteristic for the invention are set forth in the appended claims.

Although the invention is illustrated and described herein as embodied in a switch drive, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
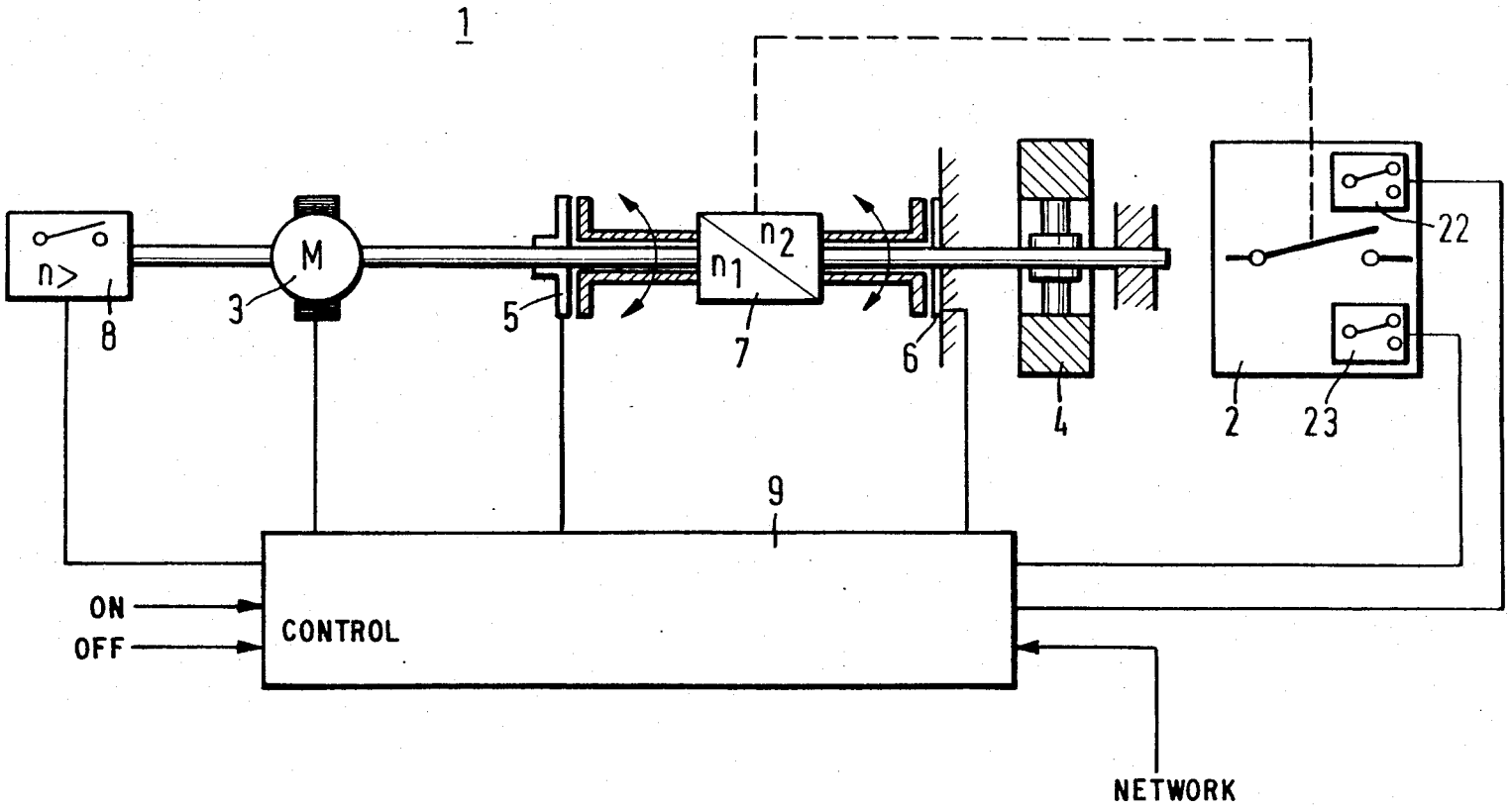
FIG. 1 is a partially schematic and partially diagrammatic cross-sectional view showing the basic construction and control of an accumulator drive with a flywheel accumulator for a disconnect switch.
Figure 2:
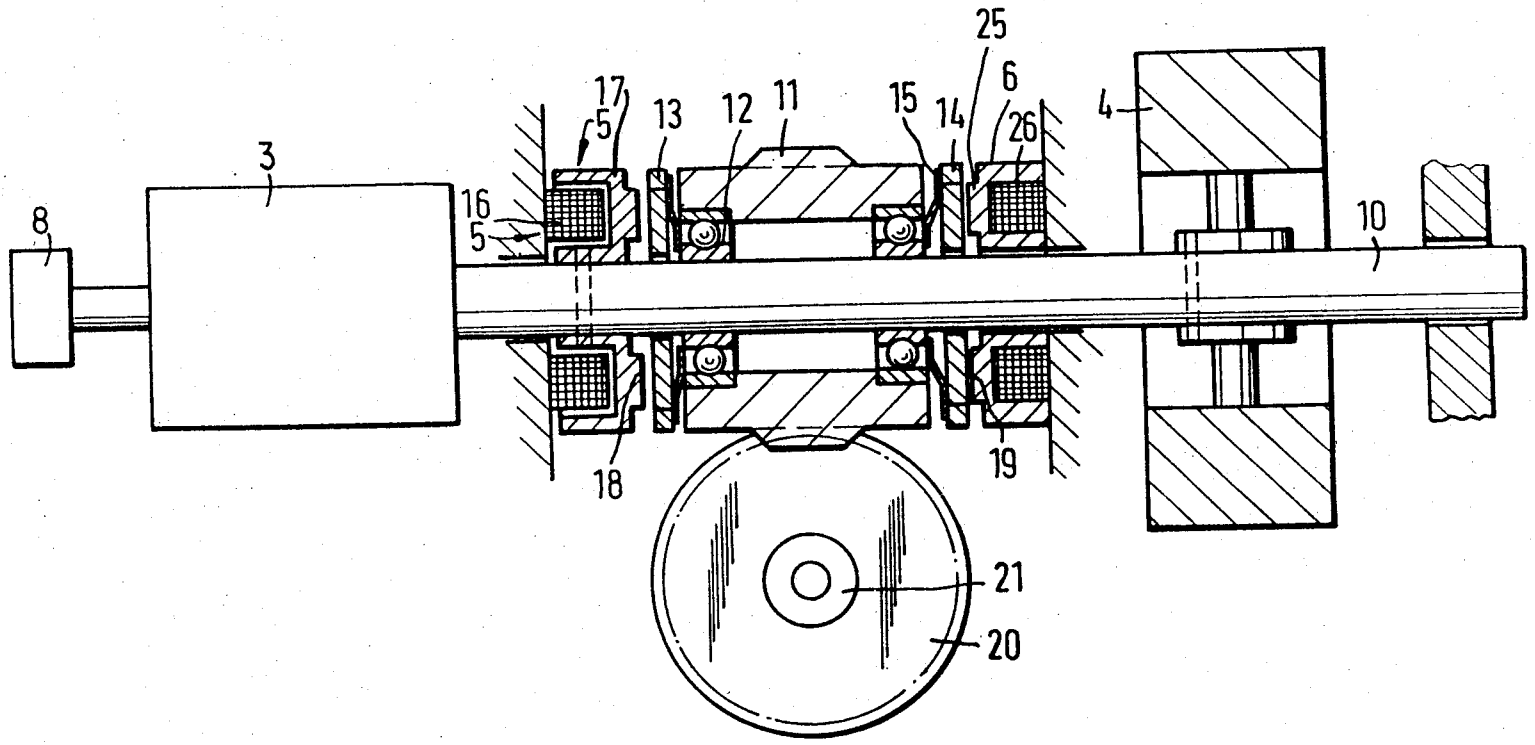
FIG. 2 is a partially cross-sectional view of the disposition of a clutch between the drive motor with the flywheel accumulator and the output for a disconnect switch according to FIG. 1.

Referring now to the figures of the drawings in detail and first, particularly, to FIG. 1 thereof, there is seen an accumulator drive 1 for a disconnect switch 2, with a drive motor 3, a flywheel accumulator 4, an electromagnetic clutch 5, an electromagnetic locking brake 6, a reduction gear 7 as well as a centrifugal switch 8. The accumulator drive 1 and the disconnect switch 2 are interconnected by an electrical control 9. The construction of the accumulator drive 1 will be described first with reference to FIGS. 1 and 2. A detailed description of the operation will then be given with the aid of a wiring diagram according to FIG. 3.

The drive motor 3 and the flywheel accumulator 4 are rigidly connected to each other by a shaft 10. A pinion 11 is mounted loosely on the shaft 10 by ball bearings 12, between the drive motor 3 and the flywheel accumulator 4. The two end faces of the pinion 11 are acted upon on one hand by the electromagnetic clutch 5 and on the other hand, by the electromagnetic locking brake 6. For this purpose, clutch rings 13, 14 are fastened to the end faces of the pinion 11 through leaf springs 15, in such a manner that the clutch rings 13, 14 react resiliently in the axial direction for coupling and locking, while they react rigidly for the transmission of the torque and for locking the pinion 11 in the direction of rotation.

The electromagnetic clutch 5 has an annular magnet coil 16, on which a circular metal cap 17 is rotatably disposed with sliding motion and fastened to the shaft 10. The metal cap 17 and the locking brake 6 have friction linings 18 and 19 at their end faces which readjust themselves automatically and thus ensure a reliable transmission of the torque from the shaft 10 to the pinion 11. The pinion 11 meshes with a gear 20 which is fastened to a control shaft 21 of the disconnect switch.

Figure 3:
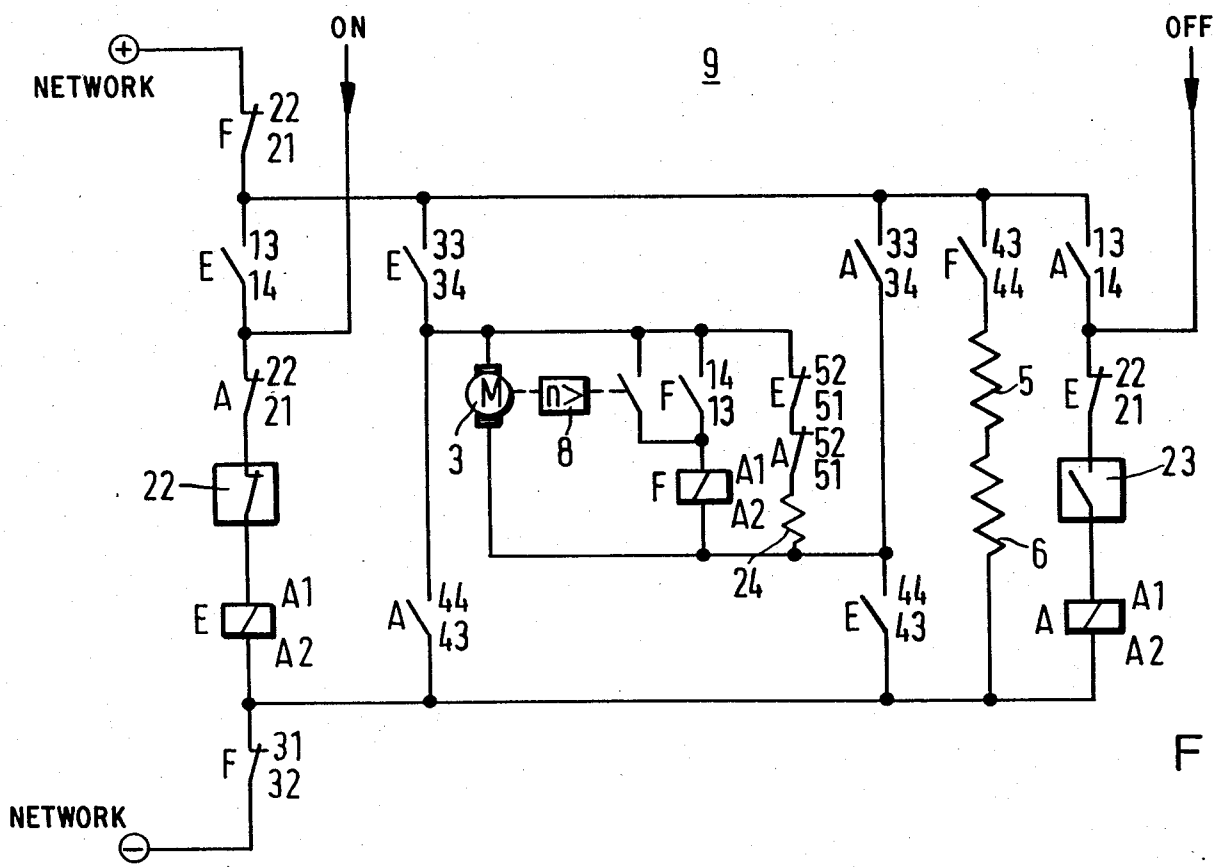
FIG. 3 is a schematic circuit diagram of a circuit for controlling an accumulator drive for a disconnect switch according to FIG. 1.

The operation of the accumulator drive 1 will be described while referring to the diagram according to FIG. 3. The wiring diagram shows the rest condition of the circuit. Upon the issuance of a command "on", a contactor E responds and goes into a self-locking state through a contact E13/14. An opening contact E21/22 assures locking in the off position during charging. Contacts E33/34–E43/44 close, so that the drive motor 3 starts up through the following elements: a (+) network, a contact F21/22, a contact E33/34, the drive motor 3, a contact E43/44, a contact F31/32 and a (−) network; and the charging of the flywheel accumulator 4 takes place. In the event of a voltage failure before the response is reached, the contactor E drops off again and the flywheel accumulator 4 runs down. The circuit is then in the rest condition again. When the voltage returns, the disconnect switch 2 cannot be tripped in any manner and furthermore, because an end switch 23 is open, a reverse direction of rotation cannot be switched to the running-down flywheel accumulator 4.

As soon as a release speed is reached, the centrifugal switch 8 closes and a release contactor F becomes self-locking through a contact F13/14. In this way the locking brake 6 is disengaged through the closing contact F43/44. The locking brake 6 is formed of a permanent magnet 25 and a winding 26, the electromagnetic field of which is oriented in such a way that while the winding 26 is energized, the magnetic field of the permanent magnet 25 is neutralized so that the locking brake 6 releases the pinion 11. The clutch 5 is operated through the simultaneously energized magnet coil 16, which establishes the frictional return connection to the gear 7. The switching process of the disconnect switch 2 has then started.

The accumulator drive 1 is disconnected from the external voltage supply and switching from motor to generator operation takes place, through the opening contacts F21/22 and F31/32. The contactor E continues to be held in the generator circuit by closed contacts E33/34, E13/14, A21/22, and end switch 22 and the contacts E44/43. The device is also self-sufficient during the critical switching phase, because of the gapless generator operation. The opened contact F31/32 also prevents countercommands which could be given during the runningdown phase of the flywheel accumulator through the external voltage.

As soon as the disconnect switch 2 has arrived in the end position, the corresponding end switch 22 opens in the "on" condition, so that the contactor E drops off. Since the contacts E33/34 to E43/44 open, the generator is disconnected at all poles, the electromagnetic clutch 5 interrupts the connection from the flywheel accumulator 4 to the transmission 7 and the locking brake 6 simultaneously fixes the disconnect switch 2 in its end position.

Although the disconnect switch travel is terminated, the contactor F in the generator circuit remains self-latching. Since the contacts F21/22 and F31/32 are open, this means that this circuit is self-locking and does not accept a countercommand as long as the generator is still running down at a critical speed.

A braking resistor 24 brakes the generator and therefore the flywheel accumulator 4 through the contacts E51/52 and A51/52, so that the drive 1 is again ready for operation within a short time.

Figure 4:
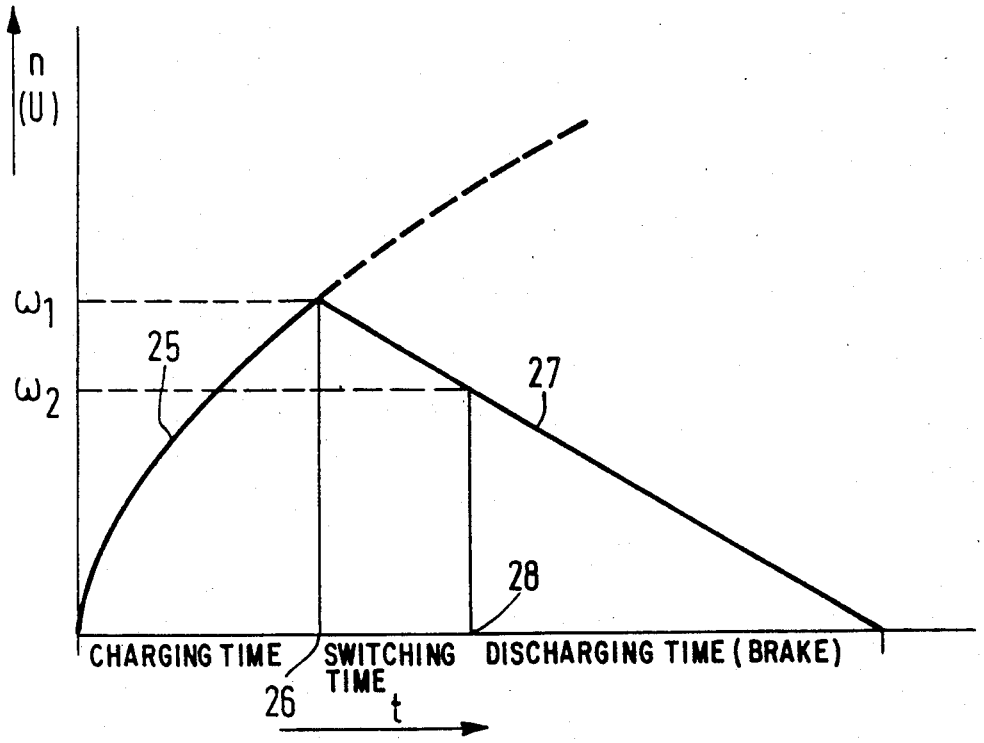
FIG. 4 is a diagram showing the speed cycle during the charging and discharging of the flywheel accumulator.

FIG. 4 shows a speed diagram, on the ordinate axis of which the speed n and the voltage U are respectively plotted, while the abscissa axis represents the time t. Starting at the coordinate origin, a curve 25 shows a relatively steep kinetic charging of the flywheel accumulator 4. At a point 26 along the curve, the centrifugal switch 8 responds and extends the discharge process of the flywheel accumulator 4 over the useful range between points 26 and 28 over the now dropping branch 27 of the curve; the disconnect switch 2 has reached its end position at the point 28. The dropping branch of the curve extending beyond the point 28 contains the unusable residual kinetic energy which is broken down by the braking resistor 24.

The foregoing is a description corresponding in substance to German application No. P 34 13 793.9, filed Apr. 12, 1984, the International priority of which is being claimed for the instant application, and which is hereby made part of this application. Any material differences between the foregoing specification and the aforementioned corresponding German application are to be resolved in favor of the latter.

We claim:

1. Switch drive assembly, comprising a switch having a contact and a control shaft for actuating said contact and switching substantially currentlessly, and a drive having a drive motor, a flywheel accumulator connected to said drive motor for receiving a charge from said drive motor immediately prior to a switching process, said flywheel accumulator being coupled to said control shaft for discharging during the switching process and executing the previously initiated switching process, said drive motor acting as a generator for generation of a flywheel-driven voltage supply; and an electrical control being driven by said flywheel-driven voltage supply for controlling the switching process during discharge of said flywheel accumulator.

2. Switch drive assembly according to claim 1, wherein said drive motor is a permanent magnet motor.

3. Switch drive assembly according to claim 1, wherein said drive motor is an universal motor.

4. Switch drive assembly according to claim 1, wherein said drive motor is a single-phase series motor.

5. Switch drive assembly according to claim 1, including a centrifugal switch for triggering discharge of said flywheel accumulator.

6. Switch drive assembly, comprising a switch having a contact and a control shaft for actuating said contact and switching substantially currentlessly, and a drive having a drive motor, a flywheel accumulator connected to said drive motor for receiving a charge from said drive motor immediately prior to a switching process, said flywheel accumulator being coupled to said control shaft for discharging during the switching process and executing the previously initiated switching process, said drive motor acting as a generator for generation of a flywheel-driven voltage supply; and an electrical control being driven by said flywheel-driven voltage supply for controlling the switching process during discharge of said flywheel accumulator, the switch including a gear disposed on said control shaft, and the drive including another shaft rigidly interconnecting said drive motor and said flywheel accumulator, and a pinion loosely disposed on said other shaft and meshing with said gear, said pinion being fixed in place during charging of said flywheel accumulator and being coupled to said other shaft during discharging of said flywheel accumulator.

7. Switch drive assembly according to claim 6, including an an electromagnetic brake for fixing said pinion in place, and an electromagnetic clutch for coupling said pinion to said other shaft, said locking brake and said clutch being supplied with voltage by said drive motor acting as a generator.

* * * * *